US005813341A

United States Patent [19]

Tojima et al.

[11] Patent Number: 5,813,341

[45] **Date of Patent: *Sep. 29, 1998**

[54] PRINT IMAGE TREATMENT DEVICE

[75] Inventors: Takahito Tojima; Ryuji Higa; Takashi Isozaki; Sadanao Okuda, all of Ibaraki-ken, Japan

[73] Assignee: Riso Kagaku Corporation, Tokyo, Japan

[ * ] Notice: The term of this patent shall not extend beyond the expiration date of Pat. No. 5,476,043.

[21] Appl. No.: 709,831

[22] Filed: Sep. 10, 1996

[30] Foreign Application Priority Data

Jun. 20, 1996 [JP] Japan ..... 8-159870

[51] Int. Cl.[6] ..... B41F 35/00

[52] U.S. Cl. ..... 101/416.1; 101/423

[58] Field of Search ..... 101/416.1, 423

[56] References Cited

U.S. PATENT DOCUMENTS 4,922,821 5/1990 Nozaka et al. ..... 101/423
5,476,043 12/1995 Okuda et al. ..... 101/416.1
5,671,675 9/1997 Okuda et al. ..... 101/424.1
5,694,840 12/1997 Isozaki et al. ..... 101/416.1

FOREIGN PATENT DOCUMENTS 0 647 531 4/1995 European Pat. Off. .

*Primary Examiner*—Edgar S. Burr
*Assistant Examiner*—Amanda B. Sandusky
*Attorney, Agent, or Firm*—Kanesaka & Takeuchi

[57] ABSTRACT

A print image treatment device is formed of a contact member which is coated on the peripheral surface with an excessive ink removing liquid incompatible with printing ink for forming a print image and having a lower surface tension than the printing ink, and is rotated in a specific direction, a facing member which serves to bring the printed side of a printed paper into contact with the excessive ink removing liquid by feeding the printed paper nipped between the contact member and the facing member, a supply means for supplying the excessive ink removing liquid to the peripheral surface of the contact member, and a cleaning means which contacts the peripheral surface of the contact member. The angle of the cleaning means from the tangent line of the peripheral surface is within a range of 5 to 60 degrees.

4 Claims, 7 Drawing Sheets

FIG. 9

| | Angle from tangent line g | Printing ink passage at the blade section |
|---|---|---|
| Example 1 | 5 (° ) | ○ |
| Example 2 | 15 (° ) | ○ |
| Example 3 | 30 (° ) | ○ |
| Example 4 | 60 (° ) | ○ |
| Comparison example 1 | 70 (° ) | × |
| Comparison example 2 | 90 (° ) | × |

PRINT IMAGE TREATMENT DEVICE

BACKGROUND OF THE INVENTION

The present invention relates to a print image treatment device to be used in a printing apparatus, such as a stencil printing apparatus and others. The present invention is particularly effective for preventing ink setoff and seeping-through in prints.

In printing in which liquid printing ink is used, there sometimes occur such disadvantages as setoff of the printed image forming ink caused by transfer of ink from the surface of a printed sheet to the back of a following printed sheet placed on top of it immediately after printing, and distortion of a printed image resulting just from lightly rubbing a printed image side with a fingertip immediately after printing; and further there will sometimes occur such a problem as the seeping-through that ink forming the printed image penetrates a printed paper through to its back side.

These problems are noticeable particularly in stencil printing in which a large amount of ink is required for forming an image on a printing paper, that is, a large amount of ink is transferred to the printing paper, as compared with other printing.

In a conventional print image treatment device, an attempt has been made to reduce the amount of ink to be transferred to the printing paper in the printing process for the purpose of preventing such setoff and seeping-through. However, it is hard to quantitatively control the amount of ink; excessive restriction of the amount of ink will result in a decreased density of a printed image and accordingly in a dimmed image, thus deteriorating the quality of the printed image.

Also, as a means for obviating the above-described problems, heating to dry the ink transferred to form an image is also considered. In this case, however, it becomes necessary to use a heater having a substantially large heating capacity. When such an ink drying means as the heater is adopted to dry the print, the higher the printing speed of a printing apparatus, the stricter the conditions to be imposed on the drying means become. Actually, it is impossible to dry the ink at such a high rate that the occurrence of setoff and seeping-through can be prevented effectively.

In some other printing systems, fine powder starch, talc, etc. is applied over a printed image side to prevent setoff. However, such a fine-dust applying device uses compressed air, which needs a considerably large printing apparatus.

When a printed paper is carried to a paper delivery tray, sorter, etc. after completion of printing, a conveyor roller must not be moved into contact with the printed image side of the printed paper in order to protect the printed image. In a prior art apparatus, the printed paper is carried by a conveying mechanism, such as a belt conveyor, which contacts only the back side (non-printed image side) of the printed paper. This type of printed paper conveying apparatus has been disclosed for example in Japanese Patent Published Unexamined Application No. Sho 50-88769.

However, in the prior art conveying apparatus, if the printed paper is conveyed in contact only with the back side of the paper, not in contact with the printed image side, the paper edges may not be aligned properly, that is, a deteriorated paper discharging performance, at a paper receiving section such as the delivery tray, sorter, etc. as compared with a copying apparatus such as PPC in which a paper is held from both sides and conveyed forcibly. This tendency becomes more and more conspicuous with an increase in the printing speed, or in other words, the paper discharge speed.

This problem tends to largely decrease the freedom of setting a paper discharging and conveying route in the printing apparatus.

The present inventor et al have invented a new device for removing excessive ink from a printing paper for the purpose of improving printing quality. This device has a contact roller which rotates while applying an excessive ink removing liquid in the form of a layer to the peripheral surface and a facing roller which faces the contact roller and rotates, for holding and conveying a printed paper by means of the contact and facing rollers. Then, the excess part of the printing ink on the printed image side of the printed paper is transferred to the layer of excessive ink removing liquid on the contact roller, which is then removed by the cleaning means such as a blade which contacts the contact roller.

In the device stated above, the printing ink transferred to the contact roller sometimes could not be removed completely depending on the inclination of the cleaning means in relation to the contact roller, that is, the angle of the cleaning means which is in contact with the peripheral surface of the contact roller. The printing ink transferred to the contact roller partly passed through a small gap between the cleaning means and the contact roller, and sometimes came in contact with the printed image on the following printed paper that was fed in with the rotation of the contact roller, consequently smearing the printed image.

In view of the above-described problems inherent to the prior art printing apparatus, it is an object of the present invention to provide a print image treatment device with an improvement of the aforesaid excessive ink removing device which is capable of exactly preventing the occurrence of setoff and seeping-through without inducing other troubles and removing excessive ink from the printed image side without seeping to the printed paper side to smear the printed paper.

SUMMARY OF THE INVENTION

A printed image treatment device according to a first aspect of the present invention has a contact member which is coated on the peripheral surface with an excessive ink removing liquid insoluble in the printing ink having a lower surface tension than the printing ink for forming the printed image and is driven to rotate in a specific direction; a facing member for holding to carry a printed paper between it and the contact member to bring the printed side of the printed paper into contact with the excessive ink removing liquid on the contact member; a supply means for supplying the excessive ink removing liquid to the peripheral surface of the contact member; and a cleaning means which contacts said peripheral surface of said contact member so that the angle of said cleaning means from the tangent line of said peripheral surface is within a range of 5 to 60 degrees.

The print image treatment device according to a second aspect of the present invention is that, in the print image treatment device of the first aspect, the contact member is an endless belt wrapped between a plurality of rollers.

The print image treatment device according to a third aspect of the present invention is that, in the print image treatment device of the first aspect, the contact member is a contact roller for holding a printed paper between it and the facing member.

The print image treatment device according to a fourth aspect of the present invention is that, in the print image treatment device of the first aspect, the cleaning means is an elastic body which has the hardness of 30 to 90 degrees and contacts the contact member with a pressure of 0.5 to 20 $kg/cm^2$.

According to the print image treatment device of the above-described constitution, at least the following function is obtainable.

The excessive ink removing liquid applied to the peripheral surface of the contact member contacts the printed image side of the printed paper. An excessive part of the printing ink forming the printed image moves to the excessive ink removing liquid on the contact member, and is removed from the printed paper. The excessive ink removing liquid is a liquid insoluble in the printing ink which forms the printed image, and is lower in surface tension than the printing ink. Therefore, the excessive printing ink that has moved to the excessive ink removing liquid is present afloat on the surface of the excessive ink removing liquid; that is, the ink is physically separate from the excessive ink removing liquid. This printing ink in a floating state is removed together with the excessive ink removing liquid from the contact member by the cleaning means which contacts the contact member surface, and is dispersed into the excessive ink removing liquid accumulated in the liquid receiving space defined between the cleaning means and the contact member. The excessive ink removing liquid inclusive of the printing ink is reliably stopped by the cleaning member without seeping through the gap between the cleaning means and the contact member.

BRIEF DESCRIPTION OF THE DRAWINGS

FIG. 9 is a table showing evaluation of an angle between the blade and the tangent line, and passage of the excessive ink removing liquid and ink under the blade, in comparison between comparison examples and the embodiment.

DESCRIPTION OF THE PREFERRED EMBODIMENTS

Figure 1:
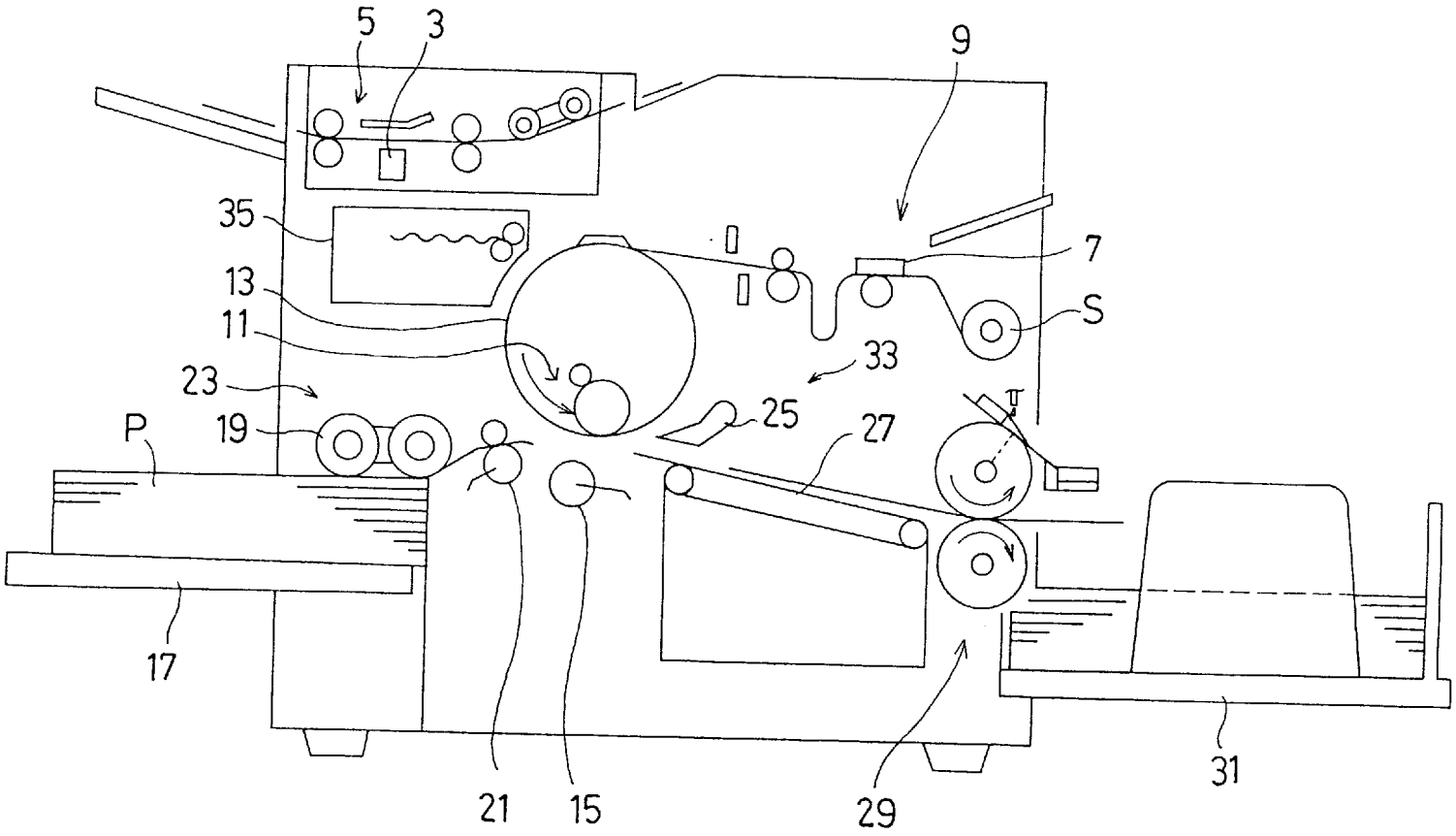
FIG. 1 is a view showing the constitution of one embodiment of a print image treatment device of the present invention.

The structure of a stencil printing apparatus of a first embodiment will be explained with reference to FIGS. 1 and 2. An original image reading section 5 has an image scanner 3 whereby an original image to be printed is read. A stencil making unit 9 has a perforating device 7, such as a thermal printing head, which forms a perforated image in a stencil sheet S in accordance with an original image data read by the image reading section 5.

Around the outer peripheral surface of a cylindrical printing drum 13 a stencil sheet S perforated at the stencil making unit 9 is wrapped. In the interior of the printing drum 13 is provided an ink supply device 11 inclusive of an ink squeegee device, whereby ink is fed to the inner peripheral surface of the printing drum 13. Beneath the printing drum 13 is disposed an impression roller 15 which moves up and down. The impression roller 15 holds to feed, between it and the printing drum 13, a printing paper P to be fed between the printing drum 13 and the impression roller 16, thereby forming an image on the printing paper P.

In a paper feeding section 23 the printing paper P on the paper supply table 17 is fed out one by one by a paper feed roller 19, and is supplied by a paper feed timing roller 21 to between the impression roller 15 and the printing drum 13.

In the paper discharge section 33, a peeling claw 25 peels a printed paper from the printing drum 13. The printed paper P thus peeled is conveyed to a print image treatment device 29 by means of a conveying apparatus 27 of a belt-conveyor mechanism. The print image treatment device 29 functions to remove excessive ink from the printed image on the printed paper P. The printed paper thus treated is discharged to a paper receiving tray 31, where the printed paper is stacked.

The stencil sheet S after printing is removed by a stencil discharge section 35 from the printing drum 13, and is discarded.

Next, printing operation in the above-described constitution will be explained. The printing drum 13 is driven to rotate counterclockwise in the drawing about the axial center of itself by means of an unillustrated driving means. The printing paper P is carried from the left to the right in the drawing by a paper feed timing roller 21 at a specific timing in synchronization with the rotation of the printing drum 13, and is supplied to between the printing drum 13 and the impression roller 15. The printed paper P is pressed by the impression roller 15 against the stencil sheet S wrapped around the outer peripheral surface of the printing drum 13 to thereby perform stencil printing.

The printed paper P is peeled from the printing drum 13 by means of the peeling claw 25, and sent, with the printed image side up, to the print image treatment device 29 by the stencil sheet conveying device 27. The printed paper P is then conveyed toward the paper delivery table 31 while being treated by the print image treatment device 29 and stacked on the paper delivery table 31.

Next, the constitution and operation of the print image treatment device 29 will be explained. As shown in FIG. 2, the print image treatment device 29 has a contact roller 37 as a contact member which contacts the printed image side (upper side) of the printed paper P after completion of printing, and a facing roller 39 as a facing member which is disposed oppositely to the contact roller 37. The contact roller 37 and the facing roller 39 are cylindrical rollers having a circumferential surface and supported parallel and rotatably by shafts 41 and 43 respectively. Each shaft is arranged mutually parallel and substantially horizontally. The facing roller 39 is pressed upward, that is, toward the contact roller 37, by an unillustrated spring which is a pressing means. When no printed paper P is present between the contact roller 37 and the facing roller 39, the contact roller 37 and the facing roller 39 are in contact with each other.

Figure 3:
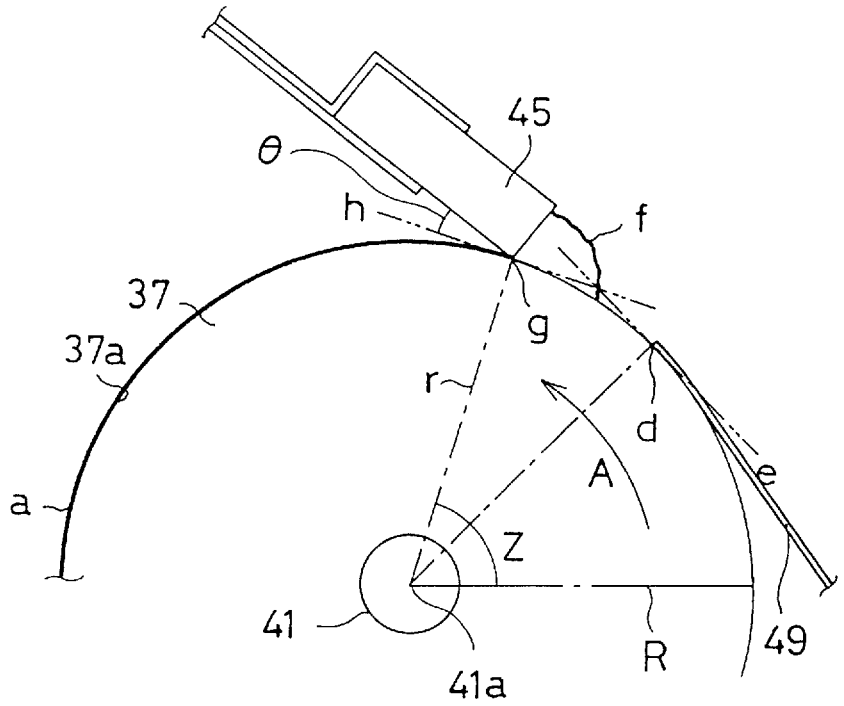
FIG. 3 is a partly enlarged view of the print image treatment device in FIG. 2.

The outer peripheral surface 37*a* (the surface coated with the excessive ink removing liquid) of the contact roller 37 is in contact with a blade 45 as a cleaning means. The blade 45 is nearly a rectangular member. The blade 45 is secured at the base end to the forward end of the sheet metal, with the forward portion of its lower end being in contact with the peripheral surface 37*a* of the contact roller 37. As shown in FIG. 3, the blade 45 is mounted in an inclined position above the top of the contact roller 37 in the counterclockwise direction in the drawing, with the forward end placed on the right lower side. The lower corner of the forward end of the blade 45 (i.e., the lower corner of the forward end) is in contact with the peripheral surface 37*a* of the contact roller 37, in a position before the top of the contact roller 37 in the direction of rotation.

In FIG. 3, the lower corner of the forward end portion of the nearly rectangular blade 45 is in contact with the peripheral surface 37*a* of contact roller 37 so that it will be substantially parallel with the centerline 41*a* of the shaft 41 of the contact roller 37. This position is called a contact position g. Suppose the tangent line h which contacts the peripheral surface 37*a* in the contact position g. The tangent line h is present on both the right and left sides of the contact position g in the drawing; in the present example, however, the angle θ between the tangent line h which is behind the contact roller 37 in the direction of rotation A with respect to the contact position g and the lower surface of the blade 46 is limited to the range of 5 to 60 degrees.

Since the blade 45 is in contact with the peripheral surface of the contact roller 37 under the above-described condition, the excessive ink removing liquid including the printing ink can not pass through the gap between the blade 45 and the peripheral surface 37*a* of the contact roller 37 and therefore remains between the front end of the blade 45 and the peripheral surface 37*a* of the contact roller 37, forming an accumulation f of the excessive ink removing liquid.

That is, the excessive ink removing liquid including the printing ink is removed from the contact roller 37; and therefore a film (a) of the excessive ink removing liquid not containing the printing ink c is regenerated on the peripheral surface 37*a* of the contact roller 37 that has passed the blade 45. The contact roller 37 contacts the printed image side of the printed paper P again with the film (a) of the excessive ink removing liquid; therefore the printed image side of the printed paper P will never be smeared with the printing ink c that has been transferred to the contact roller 37.

The blade 45 has a later-described specific hardness and is in contact with the contact roller 37 under a specific pressure. With an increase in the aforesaid angle θ in relation to the contact roller 37, the contact surface area of the blade 46 on the contact roller 37 decreases. If the contact surface area decreases, it becomes necessary to increase the pressure to be applied to the blade 45 in order to fully remove the ink that has been transferred to the contact roller 37. In this case, a load to the contact roller 37 will increase. It is, therefore, preferable that the blade 45 be installed within the range of 10 to 30 degrees.

It should be noticed that the above-described blade 45 is constituted for example of rubber or elastomer, and preferably of a fluoric material for the purpose of lowering the coefficient of friction with the contact roller and is not particularly limited to the material. The hardness of the blade 45 is set to the range of 30° to 90° on the spring-type hardness testing machine Type A specified by JIS K 6301 (established in 1975), and preferably to the range of 50 to 800. If the hardness is lower than 30° when measured under the specified pressure described later, the contact surface area on the contact roller 37 will increase, resulting in an increased friction resistance to the blade 45 and in vibration of the blade 45. It, therefore, becomes impossible to totally remove the ink c. Also if the hardness is higher than 80°, the blade 45 can not fully contact the contact roller 37, failing in removing the printing ink c.

Figure 5:
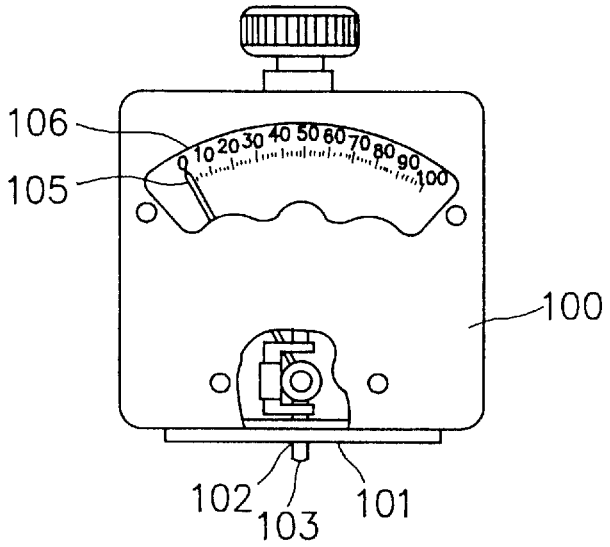
FIG. 5 is a front view of a spring-type hardness testing machine Type A specified in JIS K 6301 (established in 1975)
Figure 6:
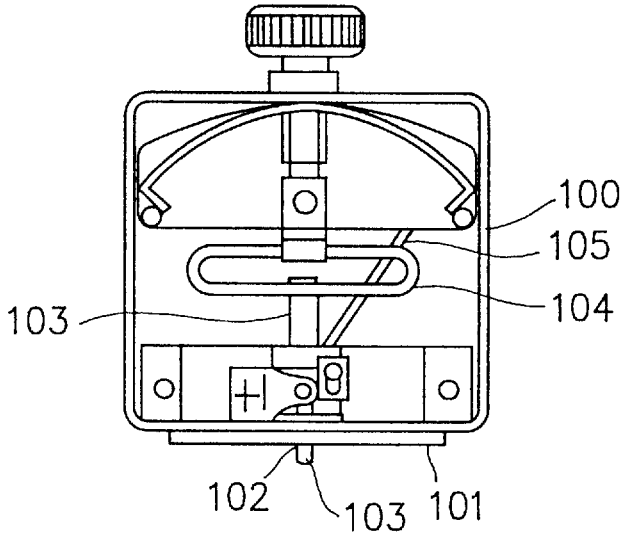
FIG. 6 is a view showing the inner mechanism of the spring-type hardness testing machine Type A specified in JIS K 6301 (established in 1975)
Figure 7:
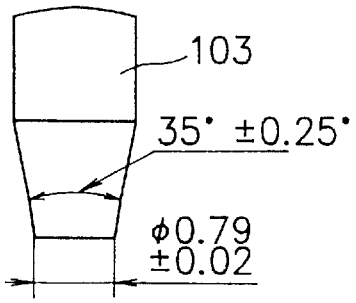
FIG. 7 is a partly enlarged view of a tip of a holder of the spring-type hardness testing machine Type A specified in JIS K 6301 (established in 1975)

The hardness test specified in JIS K 6301 (established in 1975) will be explained. The standard concerns a physical testing method for vulcanized rubber. This standard specifies a hardness test as one of physical testing methods for vulcanized rubber. The spring-type hardness testing machine Type A which is one of the testing instruments to be used in the hardness test is shown in FIGS. 5 to 7. The testing machine has a casing 100. The underside of the casing 100 serves as a pressure applying face 101 which is pressed against a test piece. A needle hole 102 is formed through the casing 100 nearly at the center of the pressure applying face. In the casing 100 an indenter needle 103 is provided. The tip of the indenter needle 103 is projecting out of the casing 100 through the needle hole 102 in the pressure applying face 101. The rear end of the indenter needle 103 is securely supported by a spring 104 provided inside of the casing 100. As shown in FIG. 7, the indenter needle 103 is a rod having a round cross section, the tip of which is of a truncated cone form having a 35±0.25° tapered surface and a 0.79±0.02 mm diameter. Inside of the casing 100 is mounted a pointer 105 which swings with the axial movement of the indenter needle 103. The casing 100 is provided with a dial scale plate 106 having a hardness scale which is indicated by the pointer 105. In measurement, the pressure applying face 101 of the spring-type hardness testing machine is pressed against the surface of a test piece to be measured. The indenter needle 103 projecting out of the casing 100 from the needle hole 102 in the pressure applying face 101 is pushed back into the casing 100 after hitting on the surface of the test piece to be measured. The pointer 105 swings correspondingly to the stroke of the indenter needle 103, thus indicating a value to be obtained on the dial scale plate 106 which indicates the hardness of the test piece.

Figure 8:
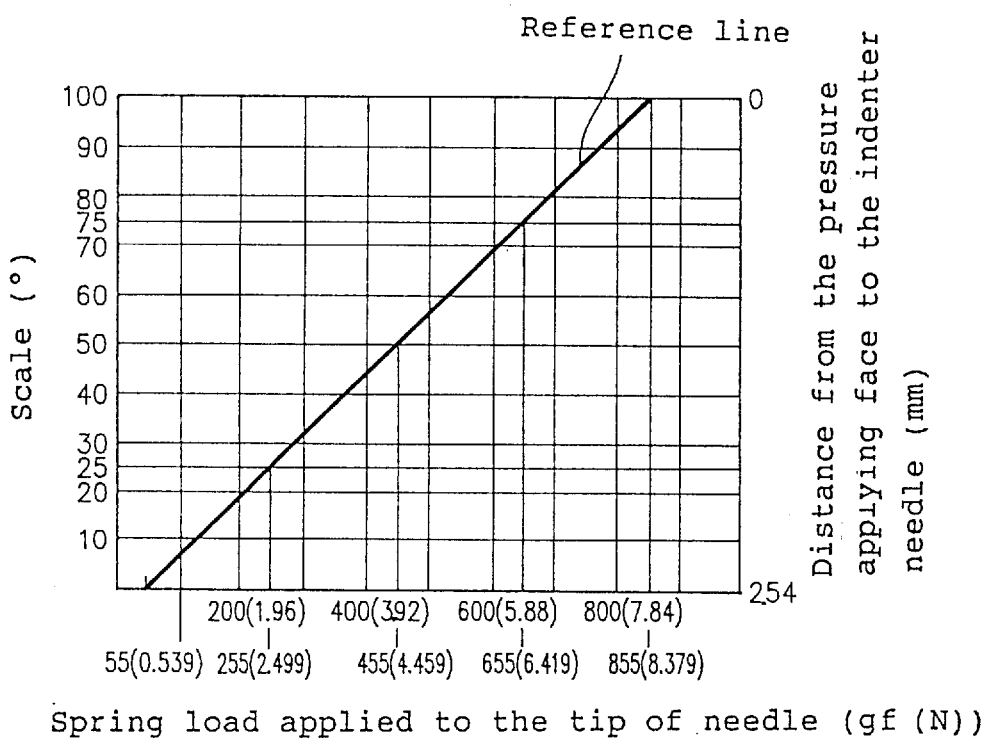
FIG. 8 is a view showing a relation, in the spring-type hardness testing machine Type A specified in JIS K 6301 (established in 1975), between the load (gf{N}) applied to the tip of an indenter needle by a spring, a hardness scale (degree) indicated on a scale plate, and a distance (mm) between a pressure applying face and the indenter needle.

FIG. 8 is a graph showing a relation between load [gf(N)] applied to the tip of the indenter needle 103 by the spring 104, a hardness scale (degree) indicated on the dial scale plate 106, and a distance (mm) from the pressure applying face 101 to the indenter needle 103.

Furthermore, it is possible to reliably stop the printing ink c by the blade 45 by setting the amount of the pressure to be exerted to the blade 45 to the range of 0.5 to 20 kg/cm$^2$, and preferably to the range of 2 to 10 kg/cm$^2$.

The position of contact between the blade 45 and the contact roller 37 is specified as follows. That is, as shown in FIG. 3, within a plane intersecting the centerline 41*a* of the axis 41, an angle Z formed by the radius r of the contact roller 37 which connect, by a straight line, the centerline 41*a* and the contact position g, and the radius R in a substantially horizontal position, is within a range of from 0 to 225 degrees in the direction of rotation A of the contact roller 37. The position of contact between the blade 45 and the contact roller 37 is a position in which a function for reliably stopping the printing ink c by means of the blade 45 is provided, and is preferably within the range of 0 to 90 degrees with an excessive ink removing liquid recovering means described later taken into consideration.

Above the peripheral surface 37*a* of the contact roller 37, an excessive ink removing liquid supply nozzle 47 is disposed before the contact position, in the direction of rotation, between the blade 45 and the contact roller 37. The excessive ink removing liquid supply nozzle 47 is a supplying means for supplying the excessive ink removing liquid to the outer peripheral surface 37*a* of the contact roller 37. The excessive ink removing liquid is a liquid which is insoluble in the printing ink for forming a printed image and has a lower surface tension than the printing ink.

The amount of the excessive ink removing liquid to be fed to the blade 45 is preferred to be more than that of the printing ink which is transferred to the contact roller 37, and is determined by the dispersion force of the excessive ink removing liquid.

The excessive ink removing liquid supplied from the excessive ink removing liquid supply nozzle 47 to the outer peripheral surface 37*a* of the contact roller 37 gathers between the blade 45 and the contact roller 37 as illustrated. With the rotation of the contact roller 37, the excessive ink removing liquid passes between the contact roller 37 and the blade 45, forming a layer on the surface of the contact roller 37. At this time, the blade 45 has a function to form a uniform layer of the excessive ink removing liquid on the outer peripheral surface 37*a* of the contact roller 37. Furthermore, the blade 45 serves also as a cleaning means to remove smudge from the outer peripheral surface 37*a* of the contact roller 37.

Before the blade 45 in the direction of rotation of the contact roller 37 there is provided a sheet-like elastic body 49 as the excessive ink removing liquid collecting means. The sheet-like elastic body 49 is a thin sheet-like member having specific elasticity. The forward end of the sheet-like elastic body 49 is in contact with the peripheral surface 37*a* of the contact roller 37 on the contact line d (parallel to the axis 41) located before the contact position between the blade 45 and the contact roller 37 in the direction of rotation A of the contact roller 37. Furthermore, the sheet-like elastic body 49 is placed in a position closer to the peripheral surface 37*a* of the contact roller 37 than to the contact surface e of the contact roller 37 at the contact line d, with its rear end being positioned lower than the forward end. Therefore, a part of the sheet-like elastic body 49 near its forward end is in firm contact by a specific length with the peripheral surface 37*a* of the contact roller 37. Accordingly the sheet-like elastic body 49 in the part is elastically deflected along the shape of the peripheral surface 37*a* of the contact roller 37.

The rear end of the sheet-like elastic body 49 is secured to an excessive ink removing liquid receiving tray member 51 disposed below the contact line d. The forward end of the sheet-like elastic body 49 is a free end, which is in contact with the contact roller 37 as previously stated. The sheet-like elastic body 49 is inclined so that it will contact the contact roller 37, at the forward end which is a free end, and that the fixed rear end will be situated in an inclined position below.

The excessive ink removing liquid used in the present embodiment is a liquid which is incompatible with the printing ink forming the printed image on the printed image side of the printed paper P, and has a lower surface tension than the printing ink. For the liquid satisfying the above-described requirements, usable are dimethyl silicone oil, and modified silicone oil such as phenyl, polyether, fluorine, amino, epoxy, carboxyl, carbinol, metacryl, melcapt and phenol for example. The excessive ink removing liquid described above is especially effective to W/O emulsion ink.

Also usable as the excessive ink removing liquid is a water solution added with a surface activator and an organic solvent.

As a surface-active agent to be added to water, anionic, cationic, and amphoteric ionic and nonionic surface-active agents are used. The amount of the surface-active agent to be added is predetermined so that the surface tension of the excess ink removing liquid will be lower than that of the printing ink.

An organic solvent to be added to water must be such an organic solvent incompatible with water as methanol, ethanol, isopropyl alcohol, n-propyl alcohol, ethylene glycol, and glycerin.

The excessive ink removing liquid is coated uniformly over the peripheral surface 37*a* of the contact roller 37; the thickness of coating is preferably about 0.0001 to 1 $\mu$m, which can be converted to about 0.1 to 100 mg/B4 size in terms of the amount of coating on the printed paper.

The contact roller 37, the facing roller 39, and the blade 45 are made of a material which will not be changed in properties such as swelling by the excessive ink removing liquid. When a main component of the excessive ink removing liquid is for example silicone oil, it is desirable that the contact roller 37, the facing roller 39, and the blade 45 be produced of fluorine resin (rubber), phenyl modified silicone resin (rubber), and urethane rubber.

Next, operation of the print image treatment device 29 of the above-described constitution will be explained. The printed paper P is held between the contact roller 37 and the facing roller 39, and is conveyed. A film (a) of an excessive ink removing liquid formed on the peripheral surface 37*a* of the contact roller 37 contacts the printed image side of the printed paper P. As a result of this contact, an excessive portion of the printing ink b forming the printed image on the printed paper P is transferred to the excessive ink removing liquid film (a) on the contact roller 37, thus removing the excessive ink from the printed paper P.

The printing ink c transferred to the film (a) of the excess ink removing liquid on the contact roller 37 passes the sliding part of the sheet-like elastic body 49 relative to the contact roller 37 with the rotation of the contact roller 37.

The excessive ink removing liquid used in the present embodiment is a liquid which is incompatible with the printing ink b forming the printed image, and has a lower surface tension than that of the printing ink c. The excessive printing ink that has been transferred to the excessive ink removing liquid, therefore, is present in a floating state, physically separately from the excessive ink removing liquid on the surface of the excessive ink removing liquid. That is, a liquid pool section f is in an emulsion state with the outer phase of the excessive ink removing liquid and the inner phase of the printing ink. In this state, the printing ink of the inner phase is floating physically separately from the excessive ink removing liquid of the outer phase.

The film (a) of the excessive ink removing liquid containing the excessive printing ink c present on the contact roller is scraped off by means of the blade 45. That is, with the rotation of the contact roller 37, the excessive printing ink is removed together with the excessive ink removing liquid from the contact roller 37 by means of the blade 45. At this time, since the blade 45 slides in contact with the contact roller 37 in order that the angle between the contact surface h in the contact position g and the underside of the blade 45 will be within the range of 5 to 60 degrees, the excessive ink removing liquid containing excessive printing ink will never pass through a gap between the blade 45 and the peripheral surface 37*a*, thus forming the excessive ink removing liquid pool section f containing the printing ink c before the blade 45 in the direction of rotation of the contact roller 37. The printing ink removed from the contact roller 37 by the blade 45 is then dispersed into the excessive ink removing liquid pool section f.

The contact roller 37 is rotating in contact with the blade 45 as described above; the contact section, when observed microscopically, is seen to be formed of the collection of a contact part and a gap part. Since the gap part is smaller than the particle diameter of most printing ink in the mixture liquid at the liquid pool section f, the passage of particles of the printing ink of the inner phase is blocked, while only the excessive ink removing liquid of the outer phase is allowed to pass through the gap part. On the peripheral surface 37*a* of the contact roller 37 after passing the blade 45, a film (a) of the excessive ink removing liquid not containing the printing ink c is regenerated. Since the contact roller 37 with this film (a) of the excessive ink removing liquid contacts again the printed image side of the printed paper, the printed image side of the printed paper P will never be smudged with the printing ink c that has been transferred to the contact roller 37.

Since the contact position between the blade 45 and the peripheral surface 37*a* of the contact roller 37 is located before the top of the contact roller 37 in the direction of rotation, the excessive ink removing liquid in the excessive ink removing liquid pool section f begins to flow with its own weight in the opposite direction of rotation of the contact roller 37 even when the contact roller 37 is rotating. This flow of the excessive ink removing liquid is guided to run along the inclined upper surface of the sheet-like elastic body 49 down into a receiving tray 51.

As the printed paper P passes between the contact roller 37 and the facing roller 39, an excessive portion of the printing ink b forming a printed image on the printed paper P as stated above is removed completely from the peripheral surface 37*a* of the contact roller 37, thereby enabling restricting the occurrence of setoff and seeping-through in the printed paper, and also thereby preventing the printed image from being destroyed if the printed image side is rubbed with a fingertip immediately after discharge. Furthermore, the printing ink b forming the printed image dries faster.

Next, examples 1 to 4 and comparison examples 1 and 2 further embodying the present invention will be explained.

(EXAMPLE 1)

Figure 2:
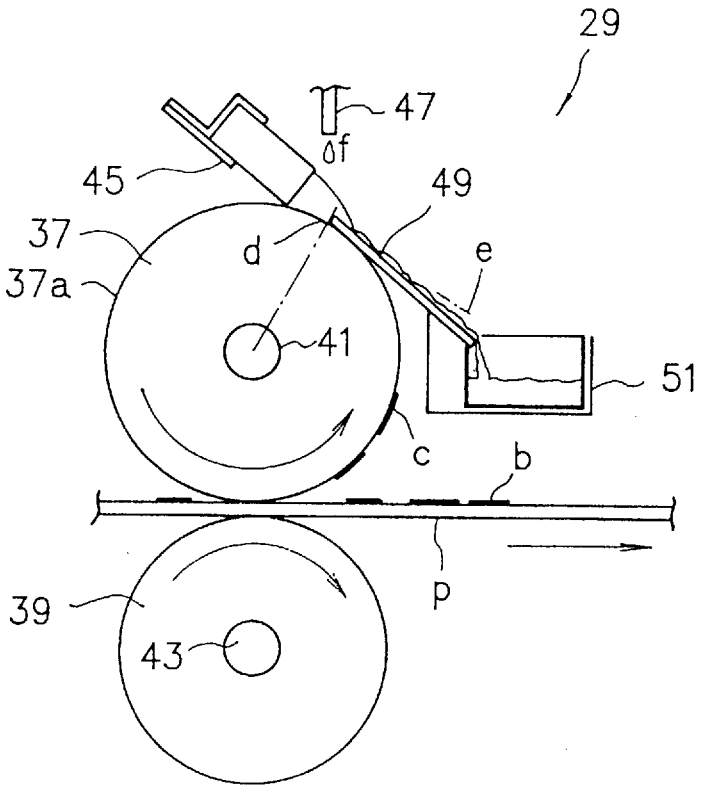
FIG. 2 is a block diagram of the print image treatment device in FIG. 1.

The apparatus of the present embodiment shown in FIG. 2 was adopted in a stencil printing apparatus (RISOGRAPH RA205 (registered trademark) manufactured by Riso Kagaku Corporation). There was provided an angle of 5 degrees between the blade 45 and the contact roller 37. For the excess ink removing liquid, dimethyl silicone oil (KF-96 produced by Shin-Etsu Chemical Co., Ltd.) was used. The blade 45 was made of a fluororubber having the hardness of 60° and used under the pressure of 3.0 kg/cm$^2$.

(EXAMPLE 2)

A device used was similar to Example 1 and had the same conditions as Example 1 except for the angle θ of 15 degrees between the blade 45 and the contact roller 37.

(EXAMPLE 3)

A device used was similar to Example 1 and had the same conditions as Example 1 except for the angle θ of 30 degrees between the blade 45 and the contact roller 37.

(EXAMPLE 4)

A device used was similar to Example 1 and had the same conditions as Example 1 except for the angle θ of 60 degrees between the blade 45 and the contact roller 37.

(Comparison Example 1)

A device used was similar to Example 1 and had the same conditions as Example 1 except for the angle θ of 70 degrees between the blade 45 and the contact roller 37.

(Comparison Example 2)

A device used was similar to Example 1 and had the same conditions as Example 1 except for the angle θ of 90 degrees between the blade 45 and the contact roller 37.

In Examples 1 to 4 and Comparison Examples 1 and 2 were made to see if the printing ink transferred to the contact roller 37 would pass the blade 45 and be transferred again to the printing paper. A result of the evaluations is shown in a table in FIG. 9.

[Evaluation Criteria]

O: Printing ink neither passes through at the blade 45 area nor is re-transferred to the printing paper.

X: Printing ink passes through at the blade 45 area, and is re-transferred to the printing paper.

Figure 4:
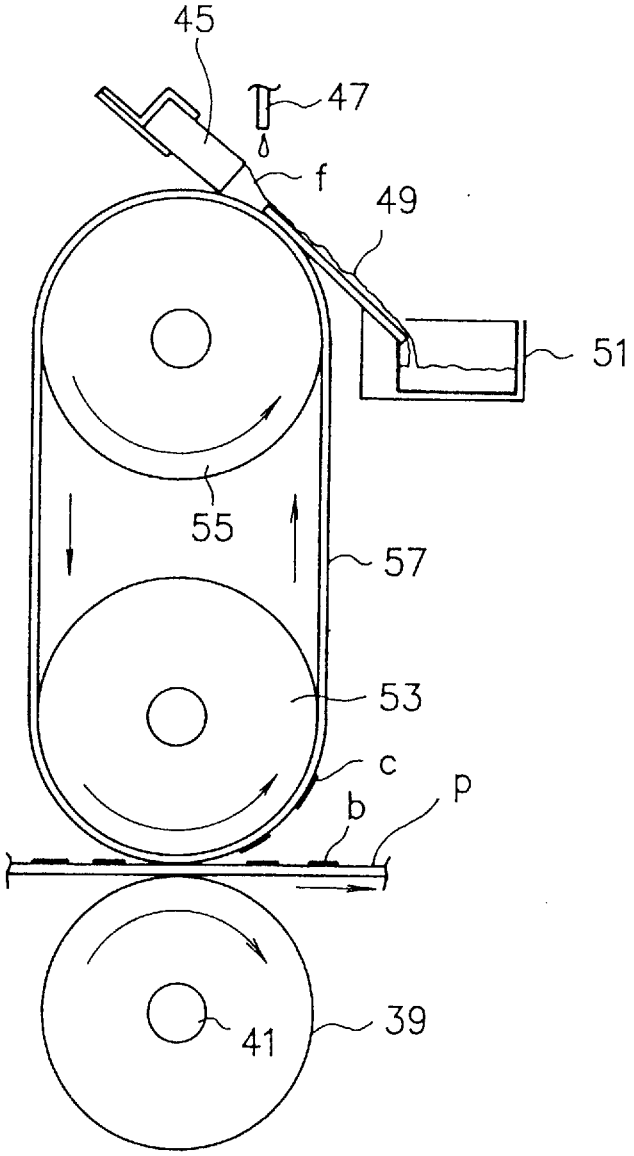
FIG. 4 is a view showing another example of constitution of the print image treatment device in the present invention.

Next, another embodiment of the present invention will be explained with reference to FIG. 4. In FIG. 4, the same members as those in FIG. 2 are designated by the same reference numerals, and are not explained. In this example, a flexible endless belt 57 as a contact member is mounted with a specific tension between two rollers 53 and 55 which are vertically spaced. According to the present example also, about the same effect as the above-described example is obtainable.

According to the present invention, the printing paper is pressed against the contact member by means of the facing member, to thereby bring the printed image side into contact with the excessive ink removing liquid on the surface of the contact member, thus enabling complete removal of the excessive part of printing ink forming the printed image from the printed paper. Therefore the setoff and seeping-through of the printing ink in the printed paper can fully be prevented without inducing any other troubles and furthermore the printed image will not be destroyed if the printed image side is rubbed with a fingertip immediately after discharge.

The excessive ink removing liquid is a liquid which is insoluble in the printing ink forming a printed image and has a lower surface tension than the printing ink; therefore the printing ink that has been transferred to the layer of the excessive ink removing liquid is present in a floating state on the surface of the layer of the excessive ink removing liquid physically separately from the excessive ink removing liquid. The printing ink in the floating state is then dispersed into the excessive ink removing liquid in the excessive ink removing liquid pool section the sliding section formed in between the plate-like cleaning means and the contact member.

The plate-like cleaning means contacts, along the tangent line, the peripheral surface of the contact member formed by a contact roller or an endless belt. Since the angle between the contact surface of the peripheral surface and the underside of the cleaning means is within the range of 5 to 60 degrees, it is possible to fully check the passage of the excessive ink removing liquid including the printing ink by the cleaning means. Therefore, the printing ink that has passed between the cleaning means and the contact member will never smear the printing paper on which printing is done.

What is claimed is:

1. A print image treatment device, comprising:

a contact member having a peripheral surface adapted to be coated with an excessive ink removing liquid incompatible with printing ink for forming a print image and having a lower surface tension than said printing ink, said contact member being rotated in a specific direction;

a facing member situated adjacent the contact member and serving to bring a printed side of a printed sheet into contact with said excessive ink removing liquid by feeding said printed sheet nipped between said contact member and said facing member;

supply means for supplying said excessive ink removing liquid to said peripheral surface of said contact member; and cleaning means which contacts said peripheral surface of said contact member, said cleaning means being an elastic member having a hardness of 30 to 90 degrees by a spring-type hardness testing machine type A specified by JIS K 6301 and contacting said contact member with a pressure of 0.5 to 20 kg/cm$^2$ and with an angle from a tangent line of said peripheral surface within a range of 5 to 60 degrees.

2. A print image treatment device according to claim 1, wherein said contact member is an endless belt mounted between a plurality of rollers.

3. A print image treatment device according to claim 1, wherein said contact member is a contact roller for nipping the printed sheet between it and said facing member.

4. A print image treatment device according to claim 1, wherein said cleaning means has the hardness between 50 and 80 degrees.

* * * * *